US005611079A

United States Patent [19]

Bain, III

[11] Patent Number: 5,611,079

[45] Date of Patent: Mar. 18, 1997

[54] FRICTIONAL SUPPORT PAD AND UTILITY BELT

[75] Inventor: Thomas D. Bain, III, Chillicothe, Ohio

[73] Assignee: PPG Industries, Inc., Pittsburgh, Pa.

[21] Appl. No.: 429,994

[22] Filed: Apr. 27, 1995

[51] Int. Cl.[6] ..... A41D 13/04

[52] U.S. Cl. ..... 2/455; 2/22; 2/51

[58] Field of Search ..... 2/48, 51, 50, 2, 2/2.5, 22, 23, 24

[56] References Cited

U.S. PATENT DOCUMENTS

| | | | |
|---|---|---|---|
| 1,004,717 | 10/1911 | White | 2/51 |
| 1,144,150 | 6/1915 | Marcovsky | 2/2 |
| 3,004,315 | 10/1961 | Masure | 2/51 X |
| 3,089,143 | 5/1963 | Jacobson | 2/338 X |
| 3,105,974 | 10/1963 | De Grazia | 2/338 X |
| 4,172,293 | 10/1979 | Vistins | 2/48 X |
| 4,174,542 | 11/1979 | Vistins | 2/48 |
| 4,359,783 | 11/1982 | Andrews | 2/48 X |
| 4,526,828 | 7/1985 | Fogt et al. | 2/48 X |
| 4,833,731 | 5/1989 | Foxman | 2/48 |
| 5,070,540 | 12/1991 | Bettcher et al. | 2/51 X |
| 5,505,356 | 4/1996 | Noriega et al. . | |

FOREIGN PATENT DOCUMENTS

| | | | |
|---|---|---|---|
| 256155 | 9/1926 | United Kingdom | 2/48 |

*Primary Examiner*—C. D. Crowder
*Assistant Examiner*—Shirra L. Jenkins
*Attorney, Agent, or Firm*—Donald C. Lepiane

[57] ABSTRACT

A pad for frictionally supporting an automotive transparency carried by an individual has bead or ridges made of friction material and is detachably secured to the belt of the individual extending over a portion of the individual's thigh. The windshield is urged against the friction material assist in maintaining the windshield above the floor as it is moved. The pad has loop portion of a hook and loop securing arrangement e.g. of the type sold under the trademark Velcro, with the hook portion secured to the belt. In this manner the pad is quickly and easily secured in position to the belt extending over the thigh portion. Tool carrying pouches and/or equipment each having the loop portion of the hook and loop arrangement mounted thereon for ease of securing them to the belt. To prevent downward movement of the belt, ends of suspenders are provided with loop portions of the securing arrangement for detachably securing the suspenders to the belt to assist in maintaining the belt in position about the waist of the individual.

4 Claims, 3 Drawing Sheets

FRICTIONAL SUPPORT PAD AND UTILITY BELT

FIELD OF THE INVENTION

This invention relates to a frictional support pad and utility belt and, more particularly, to a thigh support pad detachably secured to a utility belt to manually assist in carrying articles, the utility belt having quick release facilities for detachably securing the lift support pad to the belt, as well as suspenders, tool pouches and/or hand held tools and to a method of moving articles e.g. automotive transparencies using the pad.

DISCUSSION OF THE AVAILABLE TECHNOLOGY

In the warehousing of sheets e.g. automotive transparencies, the sheets are moved manually and/or using lifting equipment. When the sheets are moved manually, the sheet(s) is(are) engaged with gloved hands. In general the gloves are made of a cut-resistant material to protect the hands from lacerations and include beads, dots or blocks of a friction engaging material e.g. polyurethanes, or polyvinyl chloride attached to gripping surfaces of the gloves. The gloves may be made of a blended weave of polyethylene fiber sold under the trademark Spectra, aramid fibers sold under the trademark Kevlar and stainless steel filaments with a polyurethane friction engaging bead bonded to the gripping surfaces of the palms and fingers; gloves of the foregoing type are sold by Bettcher Industries, Inc. under its trademark Whizard Slipguard. Other types of gloves are sold by Prefect Fit Glove Company, Inc. and are made of a weave of aramid fibers sold under the trademark Kevlar with a polyvinyl chloride friction engaging bead bonded to the gripping surfaces of the palm and fingers. The usual practice to move automotive transparencies is to engage the upper and lowers portions of smaller transparencies e.g. sidelites, and the upper portion of the larger transparencies, e.g. windshields, by gloved hands using a pinch grip. This technique for lifting and moving automotive transparencies has limitations. More particularly, the pinch grip applied by the hands must be of sufficient force to lift and move the transparencies.

As can be appreciated, it would be advantageous to provide supporting accessories that are worn and provide frictional support for an article to be carried e.g. an automotive windshield while preventing the windshield from slipping from the supporting thigh. Further, as can be appreciated, it would be advantageous to provide supporting accessories that have facilities to quickly and easily secure the supporting accessories in a variety of positions for use and to quickly and easily remove the supporting accessories. Providing facilities to quickly and easily remove or detach the supporting accessories in the event the accessory becomes entangled with machinery or other objects.

SUMMARY OF THE INVENTION

The instant invention relates to a frictional support pad for an individual to facilitate the carrying of articles e.g. sheet articles such as automotive windshields. The support pad includes a substrate e.g. a substrate having a generally "T" shape configuration with friction material mounted on a first surface of the substrate and facilities on the substrate e.g. on the surface opposite to first surface to secure the pad in position covering a portion of or all of the thigh of the individual carrying the sheet. The friction material may include a raised portion e.g. a bead of a polyurethane or polyvinyl chloride.

The securing facilities include synthetic materials which adhere together when pressed together e.g. hook or loop portion of a securing arrangement of the type sold under the registered trademark Velcro. A belt has the loop or hook portion of the securing arrangement secured thereto for easily and quickly securing the pad on or removing the pad from the belt. In addition to securing the pad on the belt, tool pouches and/or hand held tools having the hook or loop portion of the securing arrangement secured thereto may be mounted on the belt.

In the event the belt has too much weight, suspenders having the hook or loop portion of the securing arrangement is secured to the ends of the suspenders to secure the suspenders to the belt to maintain the belt in position on the individual.

The invention further relates to a method of moving articles e.g. automotive transparencies by urging the transparency against the pad. The friction material assists in supporting the transparency above the floor.

DESCRIPTION OF THE INVENTION

This invention relates to a frictional support pad and utility belt and more particularly to a thigh frictional support and/or anti-lacerative guard pad and utility belt, and also includes suspenders for the belt and tool pouches for mounting on the belt. The thigh pad is mounted over all or a portion of the thigh of an individual to frictionally support an article, while the individual manually carries the article above the floor from a first position to a second position e.g. from a manufacturing area or storage area to a storage area or manufacturing area, respectively. Preferably the thigh pad is made of a cut-resistant material to protect the thigh against lacerations. The pad is used in combination with a utility belt to quickly and easily secure the thigh pad in position for use and to quickly and easily remove the thigh pad when not in use. Other embodiments of the invention e.g. the tool pouches and suspenders are discussed in more detail below.

In the following discussion, the article is a sheet and, in particular, an automotive transparency; however, as will be appreciated, the invention is not limited thereto and the thigh pad of the instant invention may be used with any type of article e.g. boxes, furniture or carpeting to name a few articles. Further, the invention may be practiced with any type of sheet-like articles e.g. sheet(s) of metal, wood, masonite, glass-ceramic and/or glass. Still further, the glass sheet is not limited to any particular type of automotive transparency i.e. not limited to a windshield, sidelite and/or backlite for land, air, space or water vehicles.

Figures 1, 2, 3, 4:
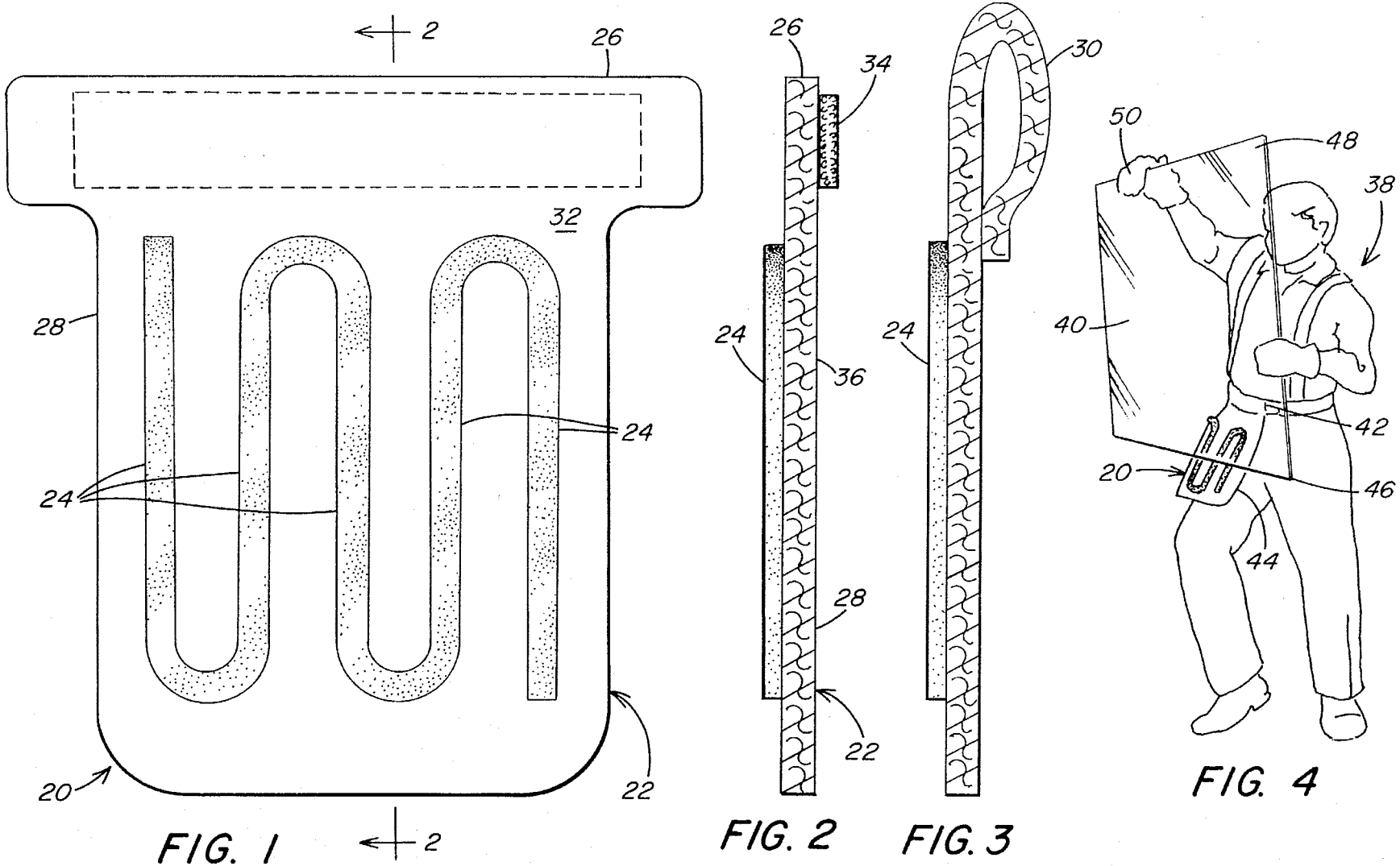
FIG. 1 is a plan front view of a thigh support pad incorporating features of the invention.
FIG. 2 is a view taken along lines 2—2 of FIG. 1.
FIG. 3 is a view similar to the view of FIG. 2 illustrating other embodiments of a facility to detachably secure the pad to the waist of an individual.
FIG. 4 is an illustration of the thigh support pad on an individual and used to support an automotive transparency e.g. an automotive sidelite.

With reference to FIGS. 1 and 2, there is shown thigh support pad 20 incorporating features of the instant invention. The pad 20 includes a substrate 22 made of a material that has resistance against cutting by the sheet material being support. For example, but not limiting to the invention, when the sheet material is glass the substrate is preferably made of (a) polyethylene fiber sold under the trademark Spectra, (b) aramid fiber sold under the trademark Kevlar and (c) stainless steel filaments weaved together. The substrate 22 is provided with raised portions 24 made of a material that provides a friction surface e.g. a bead made of a thermoplastic or thermoset polyurethane or polyvinyl chloride. A polyurethane material was applied to the substrate 22 by Bettcher Industries to provide a friction surface. The polyurethane was of the type used by Bettcher Industries for its gloves sold under the trademark Whizard Slipguard.

As can be appreciated, when transporting articles that have surfaces that may be marred e.g. glass surfaces the friction material should be a non-marring material e.g. plastic. In the instances when marring of the surface is of no concern, other types of friction material may be used e.g. grit used for sandpaper.

As shown in FIG. 1, the raised portions 24 are spaced from one another and formed to provide a continuous bead have a serpentine configuration to provide a plurality of spaced friction points for supporting the windshield. As can be appreciated, the invention is not limited to the configuration of the raised portions, and the raised portions may have any configuration and may be discontinuous rather than continuous as shown in FIG. 1.

The shape of the pad 20 is not limiting to the invention; however, it should have a width and length sufficient to cover all or a portion of the thigh of the individual carrying the windshield. The pad 20 shown in FIG. 1 has a generally "T" shape configuration with horizontal member 26 of the "T" shape providing securing portion of the pad and vertical member 28 providing friction portion of the pad. In the practice of the invention the horizontal member 26 is secured in position on the individual with the vertical member 28 extending over the thigh e.g. upper portion of the thigh of the individual. In the preferred practice to the invention, the horizontal member 26 is detachably secured around the waist of the individual e.g. the belt of the individual and preferably the utility belt of the instant invention. The horizontal member of the pad may have either hook or loop portion of a securing attachment of the type sold under the trademark Velcro secured thereto as shown in FIG. 2, or as shown in FIG. 3 may be formed to have a hook 30, for detachably securing the pad on a belt or a loop 31 (shown in phantom) for mounting the pad on a belt. The hook 30 is made of a rigid material e.g. metal to prevent the pad from slipping from the belt.

When the hook and loop attachment is used, it is recommended that the horizontal member be of sufficient length and height such that the hook or loop portion has sufficient area so that when attached to the loop or hook portion respectively secured to a belt, the pad is firmly secured on the belt. For ease of discussion the hook portion of the hook and loop arrangement is secured to the horizontal member 26; however, as will be appreciated, the invention is not limited thereto and the loop portion may be secured to the horizontal member 26 of the pad 20.

Horizontal member having a width of between about 6–12 inches (15.24–30.48 centimeters) and a height of about 2–3 inches (5.08–7.62 centimeters) as viewed in FIG. 1 is acceptable in the practice of the invention, but not limiting to the invention. Although any detachably securing feature is acceptable, it is preferred to use the hook and loop attachment for quickly and easily securing the pad on a belt in any position for use and for quickly and easily removing the pad when not in use. Removing the pad when not in use prevents the pad from interfering with movement of the individual.

In the practice of the invention, a pad 20 was made with the horizontal member 26 having a length of about 9 inches (22.86 centimeters) and a height of about 2⅜ inches (6.03 centimeters) and the vertical member 28 with a length of about 5 inches (12.7 centimeters) and a height of about 7⅝ inches (19.37 centimeters). The height and length dimensions were as viewed in FIG. 1. The substrate 22 had a thickness of about ⅛ inch (0.32 centimeter) and was made of cut-resistant Whizard® heavy duty Armguard II weaved material sold by Bettcher Industries. The raised portions 24 had a thickness of about ⅛ inch (0.32 centimeter) and a width of about ⅛ inch (0.32 centimeter). The raised portions were made of polyurethane and were on a center-to-center spacing of about 0.4 inch (1 centimeter). The raised portions 24 were applied to front surface or first surface 32 of the substrate 22 by Bettcher Industries. The surface of the pad opposite the first surface 32 as shown in FIGS. 2 and 3 is defined as the second surface and overlays the upper leg portion of the individual or human being 38 shown in FIG. 4. Sharp corners of the pad were eliminated and replaced with about 1 inch (2.54 centimeters) diameter radiused corners as shown in FIG. 1 for the pad 20. Loop portion 34 of the loop and hook attachment was sewn to back surface 36 of the horizontal member 26 of the pad, i.e. the surface opposite to the surface having the raised portions 24. The loop portion 34 had a length of about 7½ inches (19.05 centimeters) and a width of about 2 inches (5.08 centimeters). As can be appreciated, the loop portion 34 may be secured to the same surface of the pad having the raised portions 24.

Figure 5:
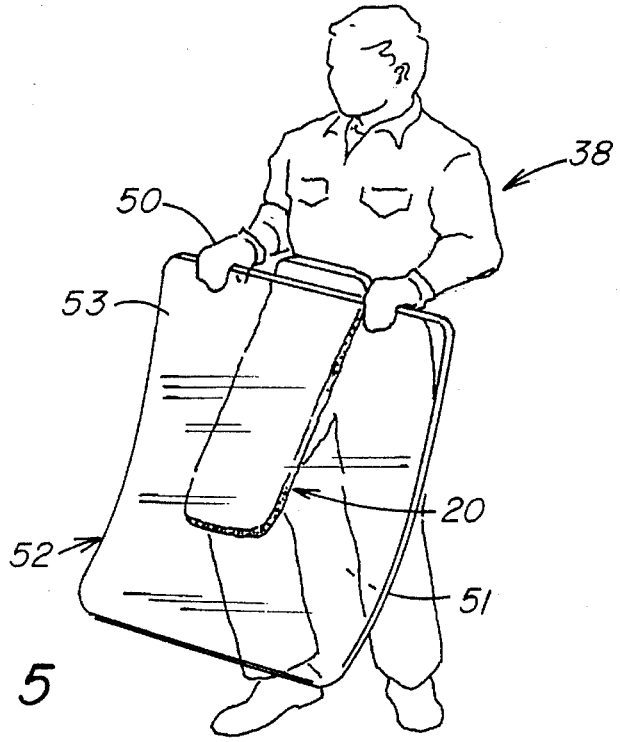
FIG. 5 is view similar to the view of FIG. 4 illustrating an individual carrying a large area automotive transparency e.g. an automotive windshield.

Pads having a rectangular shape were also made, but the preferred shape is the "T" shape. FIG. 4 illustrates an individual 38 using the "T" shape pad 20 described above to support an automotive or rear window or backlite 40 in a rest position. The pad 20 described above is secured or mounted to a belt 42 and extends downward as shown in FIG. 4 over upper portion of thigh 44 of the individual 38. Bottom edge of the backlite 40 is frictionally engaged by the raised portions 24 with upper portion 48 of the backlite 40 engaged by the individual's hands 50 wearing protective gloves. With reference to FIG. 5, when carrying larger area sheets e.g. an automotive windshield that are supported and lifted, the convex surface 51 of the windshield 52 as shown in FIG. 5 engages the raised portions (not shown in FIG. 5) with upper portion 53 of the windshield engaged by the individual's hands 50 wearing protective gloves (not shown). In the above manners, the individual may easily carry the backlite 40 (see FIG. 4) or windshield between positions e.g. between a storing or loading area and a manufacturing area. The pad of the instant invention was used in the above manner.

Figure 6:
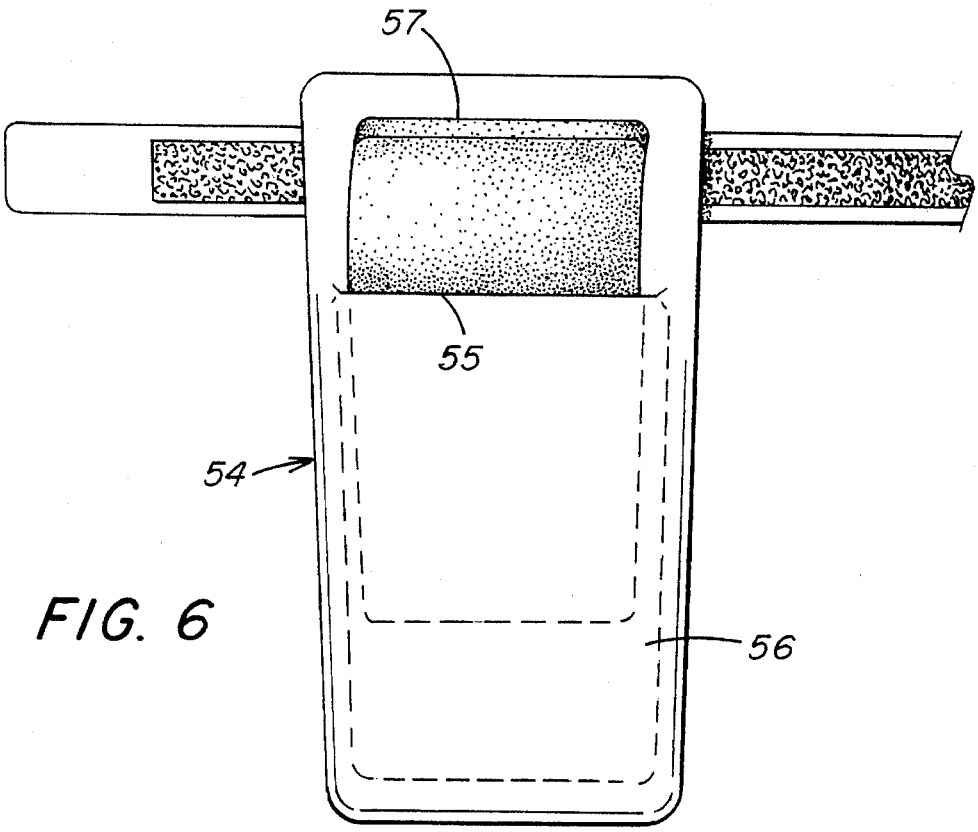
FIG. 6 is a view of the thigh support pad of FIG. 1 having a pocket for receiving padding.

With reference to FIG. 6 there is shown pad 54 of the instant invention having a pocket 55 on back surface 56 for receiving a sheet of padding 57 e.g. closed cell foam of the type sold under the trademark Ensolite.

Although the raised portions 24 have been described as being made of a friction material, as can be appreciated by those skilled in the art, when one body slides over that of another, each body exerts a frictional force on the other parallel to the surfaces contacting one another. The frictional force on each body is in a direction opposite to its motion relative to the other body. Frictional forces automatically oppose the motion and can never aid it. Even when there is no relative motion, frictional forces may exist between surfaces.

For any two given types of surfaces, which are dry and not lubricated, it is expected that the maximum force of static friction (the frictional forces acting between surfaces at rest with respect to each other) between them is approximately independent of the area of contact over wide limits but is proportional to the normal forces which hold the two surfaces together.

Further for any two given types of surfaces, which are dry and not lubricated, it is expected that the force of kinetic friction (the forces acting between surfaces in relative motion) is approximately independent of the areas of control or the speed with which the surface moves, over wide limits, but is proportional to the normal force which holds the two surfaces in contact.

From the above, it can now be appreciated that the surface roughness of the article and of the bead raised portions or 24 (see FIG. 1) as well as the downward force applied by the hands of the individual and/or gravitational force contribute to the force of friction assisting to hold the article in position against the thigh as shown in FIG. 5 as the individual moves. Although in the discussion of the invention the bead is referred to as being made of a frictional material, the surface of the article engaging the bead, the surface of the bead, the force applied by the hands of the individual and the gravitational force need to be considered when selecting the material for the bead. For example if the surface of the bead provides a high component of the coefficient of friction e.g. has a tacky surface, the surface of the article and the force applied by the hands may be reduced. In this manner, the pinch force of the hands suspending the windshield is significantly reduced. Further if the surface of the article engaging the bead and the surface of the bead provides a large component of the frictional surface, less force needs to be applied by the individual. Again, in this manner, the pinch force of the hands suspending the windshield is significantly reduced. Still further, if a large component of the force is applied by the individual, the surface of the article engaging the bead and the surface of the bead may provide a smaller component of the force. This arrangement is not preferred because it may result in cumulative trauma to the upper extremities of the individual. Gravitational force was not considered in the above discussion because it doesn't change.

From the above discussion of the invention, it can be appreciated that the pad of the invention significantly reduces cumulative trauma resulting from forceful pinch gripping.

As previously mentioned, the invention is not limited to the manner of securing the pad 20 on the individual and is preferably secured to a utility belt worn by the individual. Although not limited to the invention, the hook and loop attachment is preferred because it easily and quickly secures the pad on the belt in any location, and is easily and quickly removed e.g. detachably secured on the belt.

Figure 7:
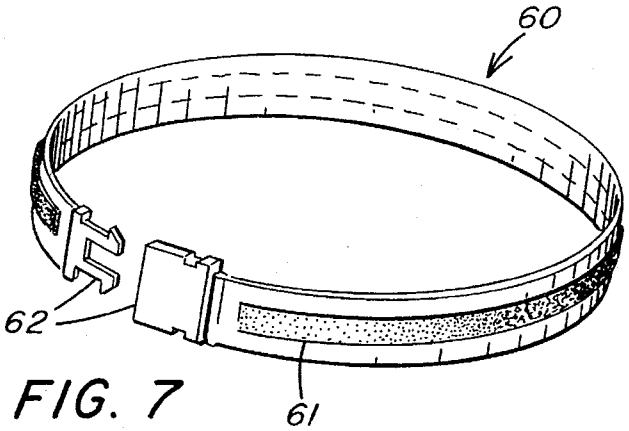
FIG. 7 is an elevated view of a utility belt incorporating features of the invention for detachably securing the pad of the invention.

With reference to FIG. 7, there is shown belt 60 incorporating features of the invention. The belt 60 is made of a durable material e.g. leather, cloth and preferably weaved material of the type used to make automotive and aircraft seat belts. The belt 60 has hook portion 61 of the hook and loop arrangement secured therein e.g. by sewing. As can be appreciated the belt 60 is provided with the loop portion when the pad has the hook portion. The hook portion 61 may be secured to the belt in discrete sections or may be a continuous strip as shown in FIG. 7. Although not limiting to the invention, the hook portion 61 should have a height greater than the height of the loop portion 34 on the horizontal member 26 of the pad 20 to increase the probability that most if not all the area of the loop portion 34 on the pad 20 is detachably secured to the hook portion 61 on the belt 60. In the practice of the invention the hook portion 61 on the belt 60 had a height of about 2 inches (5.08 centimeters).

It is preferred that the belt have a quick release buckle 62 for ease of removing and securing the belt about the waist of the individual. The ends of the belt may also be secured together by mounting a section of loop portion of a hook and loop attachment on the inner surface of the belt for engaging the hook portion 61 on the outer surface of the belt. Further, buckles used on automotive seat belts may be used in the practice of the invention to secure the ends of the belt together.

In the practice of the invention a 2 inch (5.08 centimeter) wide nylon belt having a quick release buckle of the type sold by McMaster-Carr was used. The hook portion 61 was secured on the outside of the belt. In the practice of the invention it is preferred to have a 3 inch (7.62 centimeter) wide car seat belt with a quick release buckle of the type sold by ITW Nexus of Woodside, Ill. 60191 under the mark Fastex SR-2 showing U.S. Pat. Nos. 4,150,464 and 4,171,555; the disclosure of the patents are hereby incorporated by reference.

As can now be appreciated, in the practice of the invention, the article being carried is frictionally engaged by the pad. The weight of the article urges the pad downward as viewed in the FIGS. 4 and 5; however, the pad is held in position by the belt 60. In this manner, the gripping force of the hands is reduced.

Figure 8:
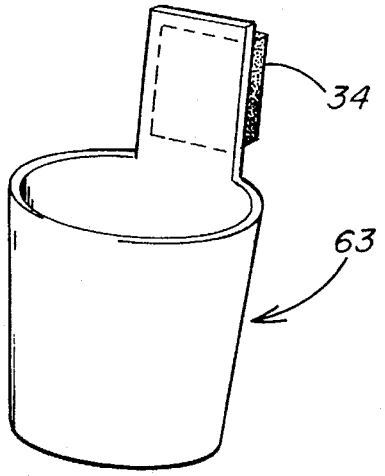
FIG. 8 is a prospective view of a tool pouch incorporating features of the invention for detachably securing the pouch on the belt of the instant invention.

As can now be appreciated, the belt of the instant invention may be used to secure the pad 20 in position as was discussed, as well as tool pouch 63 shown in FIG. 8. The tool pouch 63 is made of cut resistant material of the type discussed above for carrying utility knives, pliers or screwdrivers. The pouch 63 has loop portion 34 of the hook and loop arrangement secured thereto to secure the pouch to the belt. Tool pouches sold by McMaster-Carr were modified by removing the upper belt attachment portion and a piece of flexible suede sewn to the lower portion of the pouches. The loop portion was sewn on the suede.

Figure 9:
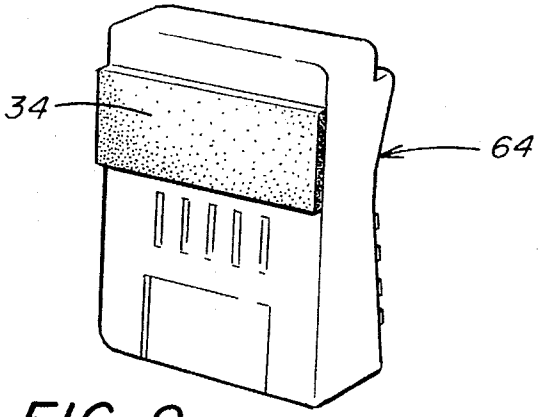
FIG. 9 is a prospective view of an instrument incorporating features of the invention for detachably securing the instrument on the belt of the instant invention.

Instruments and equipment identified by number 64 in FIG. 9 may also be provided with the loop portion 34 for mounting on the belt 60. For example, and with continued reference to FIG. 9, a sheet scanner 64 of the type disclosed in U.S. Pat. No. 4,298,790 (identified in the patent by numeral 20) has the loop portion 34 mounted thereon for detachably securing the counter 64 to the belt. The disclosure of U.S. Pat. No. 4,298,790 is hereby incorporated by reference.

Figure 10:
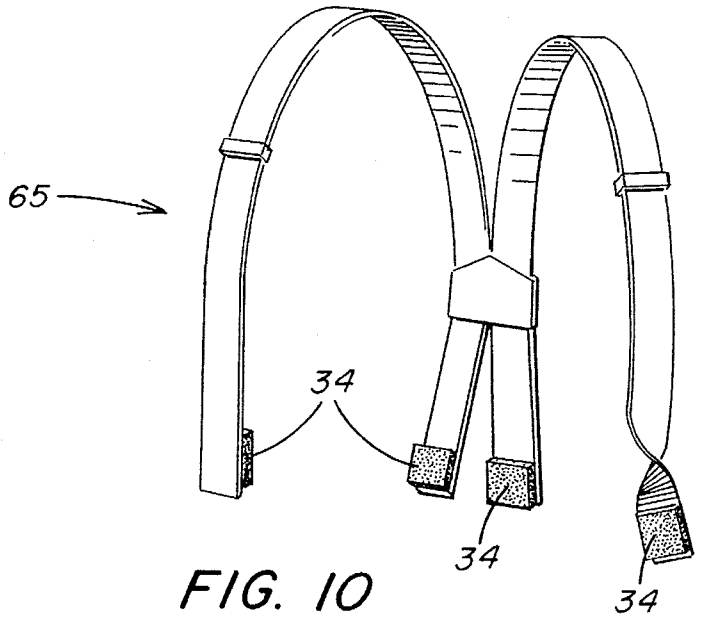
FIG. 10 is an elevated view of suspenders incorporating features of the invention for use with the belt of the instant invention.

In the instance where the weight of the accessories to be carried on the belt pull the belt down, suspenders may be used. With reference to FIG. 10, suspenders 65 have the loop portion 34 secured on the ends for securing the ends of the suspenders 65 on the hook portion 64 of the belt.

As can be appreciated, the above description of the embodiments of the invention were presented for illustration purposes and are not limiting nor intended to limit the invention.

What is claimed is:

1. A method of supporting an article in an elevated position comprising the steps of:

providing a pad, the pad comprising a substrate made of a cut resistant material, the substrate sized to cover only portion of one leg of an individual between the knee and waist of the individual defined as the upper leg portion, the substrate having an outer surface defined as a first surface and an opposite outer surface defined as a second surface with a frictional material adhered to the first surface;

securing the pad to the waist of the individual with the second surface of the substrate overlaying and facing the upper leg portion of the individual;

maintaining an article in an elevated position while supporting the article on the frictional material, and moving the article from a first position to a second position while practicing the maintaining step.

2. The method according to claim 1 wherein the article is a sheet.

3. The method according to claim 2 wherein the sheet is an automotive transparency and the maintaining step includes the step of gripping an edge of the transparency while supporting another edge of the transparency on the friction material.

4. The method according to claim 2 wherein the sheet is an automotive windshield and the gripping step includes the step of engaging an edge of the windshield while supporting a major surface of the windshield on the friction material.

* * * * *